United States Patent [19]

Musolff et al.

[11] Patent Number: 4,673,236

[45] Date of Patent: Jun. 16, 1987

[54] CONNECTOR ASSEMBLY

[75] Inventors: Frank Musolff, Walldorf; Volker Sillmann, Heidelberg, both of Fed. Rep. of Germany

[73] Assignee: Allied Corporation, Morris Township, Morris County, N.J.

[21] Appl. No.: 788,991

[22] Filed: Oct. 21, 1985

[30] Foreign Application Priority Data

Oct. 24, 1984 [DE] Fed. Rep. of Germany ... 8431274[U]

[51] Int. Cl.[4] ..... H01R 13/658

[52] U.S. Cl. ..... 439/609

[58] Field of Search ..... 339/143 R, DIG. 3

[56] References Cited

U.S. PATENT DOCUMENTS

| | | | |
|---|---|---|---|
| 2,762,025 | 9/1956 | Melcher | 339/143 R |
| 3,678,445 | 7/1972 | Brancaleone | 339/143 R |
| 4,118,092 | 10/1978 | Sado et al. | 339/DIG. 3 |
| 4,239,318 | 12/1980 | Schwarz | 339/143 R |
| 4,326,768 | 4/1982 | Punako | 339/143 R |
| 4,349,241 | 9/1982 | Juris et al. | 339/143 R |
| 4,423,919 | 1/1984 | Hillis | 339/143 R |
| 4,428,639 | 1/1984 | Hillis | 339/143 R |
| 4,470,657 | 9/1984 | Deacon | 339/143 R |
| 4,512,623 | 4/1985 | Tomsa | 339/143 R |

FOREIGN PATENT DOCUMENTS

| | | | |
|---|---|---|---|
| 2025158 | 1/1980 | United Kingdom | 339/143 R |
| 2073503 | 10/1981 | United Kingdom | 339/143 R |
| 2127626 | 4/1984 | United Kingdom | 339/143 R |

*Primary Examiner*—John McQuade

*Attorney, Agent, or Firm*—Roger H. Criss

[57] ABSTRACT

A connector assembly having enhanced shielding against electromagnetic interference. A second ground connection between the plug and the socket is provided which is in the form of a contact ring. The additional contact ring has grounding fingers and is spaced behind the first contact ring to provide a multiple barrier against interference. The slots of one contact ring are offset from the slots of the other ring.

2 Claims, 2 Drawing Figures

CONNECTOR ASSEMBLY

BACKGROUND OF THE INVENTION

1. Field of the Invention

This invention relates to a shielded electrical plug and socket connector assembly.

2. Description of the Prior Art

This invention relates to a connector assembly consisting of a plug and a socket for lines shielded against electromagnetic waves and having at least one conductor, with a first, at least partially elastic ground contact ring fastened to the periphery of the housing of either the plug or the socket and establishing a ground connection between the plug and socket.

Such connectors are known and are used where safety against interfering external influences must be assured. Applications can be found, for instance, in data processing and data transmission as well as in the military area.

It has turned out, however, that shielding by means of the ground connector may not be sufficient in all applications.

It would be desirable to provide a connector which has a better shielding and has a greater safety against interference.

In accordance with this invention, there is provided a connector assembly commprising a plug and a socket for lines shielded against electromagnetic waves and having at least one conductor, with a first, at least partially elastic ground contact ring fastened to the periphery of the housing of either the plug or the socket and establishing a ground connection between the plug and socket, characterized in that at least one additional ground contact ring is provided which establishes a second ground connection between the plug and the socket, the additional contact ring being at least partially elastic and being disposed at an axial distance from the first ground contact ring.

The above problem is thus solved in that at least one further ground contact ring establishing a second ground connection between the plug and the socket and being at least partially elastic is disposed at an axial distance from the first ground contact ring.

The ground contact rings, also known as "grounding fingers", may both be disposed on the outside surface of the plug housing as well as on the inside surface of the socket housing. It is important that they be fastened axially one behind the other, thus forming a double or multiple barrier for interference radiations or reducing the coupling resistance between socket and plug. An arrangement of the ground contact rings on the plug housing as well as on the socket housing is also possible, the appropriate combination being determined by engineering or design conditions.

In a further development of the invention the ground contact ring may be formed in one piece of a spring steel strip which is fastened unilaterally and annularly to the housing and contains freely elastic tongues formed by axial slots. The length of the slots matches approximately the free spring length.

In another embodiment of the invention, the slots of the first ground contact ring are offset in circumferential direction relative to the slots of the further ground contact ring(s). As a result, even better shielding is thereby achieved.

In another embodiment, the ciontact rings are formed as a ring of conductive rubber or plastic and are mounted such that a reliable ground contact is made when the plug is plugged into the socket.

DESCRIPTION OF THE PREFERRED EMBODIMENTS

Figure 1:
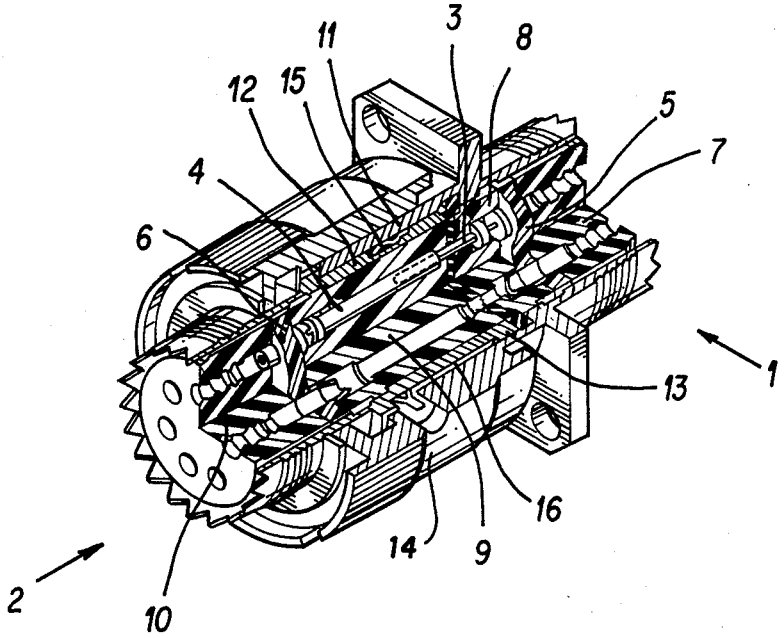
FIG. 1 shows the connector assembly of this invention.
Figure 2:
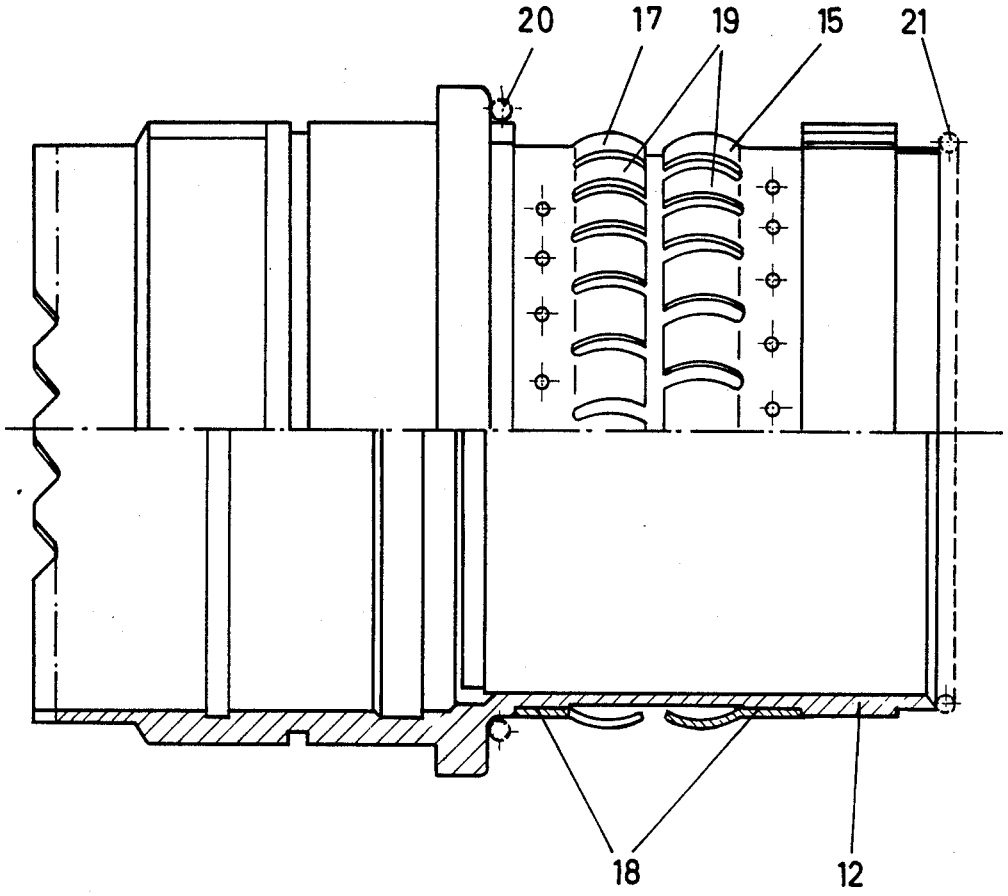
FIG. 2 shows the arrangement of the ground contact rings on a plug part in semisection.

The connector assembly shown in FIG. 1 consists of a socket 1 equipped with connector pins 3 and of a plug 2 equipped with pin bushings 4. The pins 3 and the bushings 4 are each fastened in contact carriers 5, 6. The contact carriers are enclosed by insulating gaskets 7 to 10 guaranteeing the tightness of the connector. An extension of the socket 1, designed as sleeve 11, grips over a plug extension likewise designed as sleeve 12. This assures the axial-symmetrical coordination of the plug and the socket. The contact coordination of the concentrically arranged pins 3 and bushings 4 (hereinafter called contacts) is accomplished by at least one keyway slot 16 disposed in the socket sleeve 11 and engaged by a key 13 on the plug sleeve 12. The connector is secured by a coupling nut 14 rotatably mounted on the plug 2 and preventing an unintentional disconnect through a screw or bayonet connection. A ground contact 15 is disposed between the sleeves 11, 12 for grounding and shielding. Connectors of this kind are produced commercially with different numbers of contacts but the same outside dimensions and the same construction, e.g. also for coaxial cables. It has turned out that one ground contact ring 15 effectively shields up to about 60 dB. To achieve increased damping (e.g. over 90 dB), a second ground contact ring 17 is disposed next to the first ground contact ring 15, as shown in FIG. 2. For better clarity, only the plug sleeve 12 with the ground contact rings is shown in FIG. 2. Annular bearing surfaces 18 of the ground contact rings 15, 17 are fastened to the sleeve by spot welding, with the opposite edge portions of rings 15, 17 being disposed at the endwalls of an annular groove provided in the sleeve. The ground connection to the socket is established via small spring elements 19. These spring elements are staggered, i.e., the slots of the ground contact rings 15 are covered up in axial direction by the spring elements of the ground contact ring 17.

The ground connection may also be established by elements other than the ground contact rings 15, 17. One preferred ground connection can be realized by O-rings 20, 21 of conductive rubber, shown in a broken line in FIG. 2. They are arranged at the faces of sleeve 12 so that a good contact with the socket and, hence, good shielding is provided when mating the connector.

This invention thus provides a multiple barrier for reduced interference in the connector.

What is claimed is:

1. A connector assembly comprising a plug and a socket for lines shielded against electromagnetic waves and having at least one conductor, with a first, at least partially elastic ground contact ring disposed in an annular groove in the housing of either the plug or the socket and establishing a ground connection between the plug and the socket, characterized in that at least one additional ground contact ring is provided which establishes a second ground connection between the plug and the socket, said additional ground contact ring being at least partially elastic and being disposed in said annular groove and at an axial distance from said first ground contact ring, each ground contact ring being formed of a spring steel strip and having a first edge portion immovably fastened to said annular groove and a second edge portion in the form of a spring comb having spring fingers oriented radially, said spring fingers being defined by radial slots extending from said second edge portion to said first edge portion and said spring fingers having free ends, the free ends of said spring fingers of each contact ring facing the free ends of the other contact ring but being spaced therefrom and being offset in the circumferential direction such that said slots of one of said contact rings confront the free ends of said spring fingers of said other contact ring, whereby the shielding effectiveness is improved.

2. The connector assembly of claims 1, characterized in that said first edge portions of said contact rings are disposed at opposite endwalls of said annular groove and said spring combs have a concave form.

* * * * *